US006117488A

United States Patent [19]

Erickson

[11] Patent Number: 6,117,488

[45] Date of Patent: Sep. 12, 2000

[54] NON-SAG LIQUID APPLICATION METHOD

[76] Inventor: Dennis Erickson, 31 Shirley St., Wilbraham, Mass. 01095

[21] Appl. No.: 09/160,086

[22] Filed: Sep. 25, 1998

[51] Int. Cl.[7] ..... B05D 1/34

[52] U.S. Cl. ..... 427/261; 427/256; 427/421

[58] Field of Search ..... 427/256, 385.5, 427/284, 421, 484, 261

[56] References Cited

U.S. PATENT DOCUMENTS

| | | | |
|---|---|---|---|
| 3,782,328 | 1/1974 | Franz | 118/118 |
| 3,944,701 | 3/1976 | Dennis | 427/288 |
| 4,018,953 | 4/1977 | Martellock | 427/430 |
| 4,138,284 | 2/1979 | Postupack | 156/100 |
| 4,139,660 | 2/1979 | Tur | 427/353 |
| 4,152,807 | 5/1979 | Smahlik | 15/246 |
| 4,345,546 | 8/1982 | Weber | 118/675 |
| 4,455,322 | 6/1984 | Weber | 427/8 |
| 4,527,507 | 7/1985 | Sawai | 118/314 |
| 4,597,931 | 7/1986 | Watanabe | 264/129 |
| 5,002,809 | 3/1991 | Nakahama | 427/407.1 |
| 5,063,085 | 11/1991 | Yamane | 427/240 |
| 5,141,156 | 8/1992 | Hoy | 239/135 |
| 5,153,027 | 10/1992 | Spagnoli | 427/163 |
| 5,212,000 | 5/1993 | Rose | 428/34.7 |
| 5,500,274 | 3/1996 | Francis | 428/156 |
| 5,521,477 | 5/1996 | Sasaki | 318/568.18 |
| 5,632,813 | 5/1997 | Nakagawa et al. | 118/58 |
| 5,686,148 | 11/1997 | Suzuki | 427/444 |
| 5,705,470 | 1/1998 | Faris | 510/403 |
| 5,728,742 | 3/1998 | Staples et al. | 521/57 |

FOREIGN PATENT DOCUMENTS

| | | |
|---|---|---|
| 0 412 183 | 2/1991 | European Pat. Off. . |
| 0 646 419 | 4/1995 | European Pat. Off. . |

OTHER PUBLICATIONS

P.E. Pierce et al., "Coating Film Defects", Fed. of Soc. for Coatings Tech., 1988, pp. 6–24.

*Primary Examiner*—Fred J. Parker
*Attorney, Agent, or Firm*—Thomas E Kelley; Mark F. Wachter

[57] ABSTRACT

This invention provides a method for producing a substantially non-sag liquid mixture coating on a substantially vertical surface by applying a coating having continuously increasing thickness from one edge to another edge of the liquid mixture composed of at least two miscible liquid components and situating the edge at which the surface tension of the coating liquid mixture will be greater, as the more volatile liquid component evaporates, at a higher vertical position than the other edge.

2 Claims, 2 Drawing Sheets

NON-SAG LIQUID APPLICATION METHOD

BACKGROUND OF THE INVENTION

1. Field of the Invention

The present invention is related to methods of applying a liquid to a substantially vertical surface. In particular, this invention is related to methods of applying liquids to substantially vertical surfaces to form substantially non-sag films or coatings.

2. Related Background Art

Liquid coatings applied to vertical surfaces are susceptible to defects commonly known as sagging, running, dripping and curtaining, as described in Percy E. Pierce and Clifford K. Schoff, Coating Film Defects (Federation of Societies for Coatings Technology, 1988), the disclosure of which is incorporated by reference herein. These defects arise when the action of gravitational forces on the coating film results in downward flow of the film.

It is often desirable to form a film or coating, that is substantially without the above-described defects, on a substrate surface. Such non-sag films provide consistent and isotropic properties throughout the film or coating. Properties such as color, opacity, resistance, and mass are typically desired to be uniform in coatings or films. Non-uniformity of thickness caused by sagging, dripping curtaining or running can lead to undesirable color gradients, uneven hiding of the substrate hue, areas more prone to corrosion, and "orange peeling".

In particular, it is often desirable to form a film or coating that is substantially even, without sag, on a substrate that is substantially inclined, especially a substrate at or very near vertical.

The conventional remedies involve modification of the viscosity or thickness of the film. Reducing the film thickness decreases the flow velocity in the liquid coating, allowing the coating to dry or cure before noticeable defects arise. However, the decreased film thickness requires multiple applications of coating to achieve thicker overall coating thicknesses. Increasing the coating viscosity also decreases the flow velocity, and is typically accomplished by adding thickeners or thixotropes, or by using a solvent that evaporates relatively quickly. Modifying the coating formulation in this way, however, adds to the cost of the coating and may be detrimental to other properties of the coating.

A particularly difficult problem arises when a non-sag coating is required from liquids with low or zero solids loadings. Such mixtures of miscible liquids can undergo wide changes in rheological properties as their component ratios change because of the different evaporation rates of each component. This problem, of how to form a non-sag coat of miscible liquids to a substantially vertical surface, has not been adequately addressed.

U.S. Pat. No. 4,018,953 describes mounting, on a cylinder, a coating collar that forms a trough into which is poured the coating liquid. The liquid is applied to the cylinder by sliding the collar down the cylinder to form a thin coating of the liquid on the outer surface of the cylinder.

U.S. Pat. Nos. 4,345,546 and 4,455,322 describe methods and apparatus for coating items in which an object is immersed into a solution and removed from the solution at a constantly changing speed in order to form a coating that is thinner at the top and bottom and thicker at the center.

U.S. Pat. No. 4,597,931 describes forming a windshield with a varying thickness produced by dipping the windshield base in a coating solution and withdrawing the base from the solution at a varying speed.

U.S. Pat. No. 5,002,809 describes applying an urethane base coating material to a vehicle surface in overlapping coatings.

U.S. Pat. No. 5,063,085 describes a coating method that applies a coating to an object and rotating the object to prevent sagging.

U.S. Pat. No. 5,153,027 describes applying a varying thickness coating by immersing an object into a bath of the coating liquid and withdrawing the object in a predetermined direction at a predetermined rate while simultaneously pivoting the object at a predetermined angular velocity.

U.S. Pat. No. 5,212,000 describes applying nonNewtonian coating fluids to the inner surfaces of hollow tubes.

U.S. Pat. No. 5,521,477 describes a method for evaluating coating sag in order to teach a robotic spray coater to apply a uniform coat. The patent mentions surface tension without providing any guidance about how to use surface tension to control the uniformity of an applied coating.

U.S. Pat. No. 3,782,328 describes spray coating a horizontal substrate with a squeegee/shield apparatus downstream of the spray in order to prevent formation of non-uniform banding or streaking.

U.S. Pat. No. 3,994,701 describes a method of applying a uniform thickness of a processing fluid by tapering the spread-thickness control components of the film assemblage in order to provide more resistance to movement during the beginning of the process of spreading the fluid, when there is more fluid to be spread, and less resistance later as the amount of the fluid to be spread decreases.

U.S. Pat. No. 4,138,284 describes a method to form a colored shade band on a substrate by spray coating along a mask edge.

U.S. Pat. No. 4,152,807 describes a scrubbing attachment to apply a solution to a window.

U.S. Pat. No. 4,527,507 describes spray apparatus with overlapping spray patterns that have overlap-coat regions as thick as the center single-coat regions.

U.S. Pat. No. 5,141,156 describes obtaining a feathered spray of a liquid using airless spray techniques.

U.S. Pat. No. 5,500,274 describes providing a laminated glazing having an optical density gradient band by forming a coating of variable thickness and gradient coloration in the cross-web direction.

U.S. Pat. No. 5,705,470 describes a sprayable cleaning gel composition that clings to a surface without running.

A method for producing a substantially non-sag coating of miscible liquids on a vertical surface would be extremely useful. Such a method would be very useful in many applications. Such applications include, for example, window cleaners, oven cleaners, and any application that would benefit from a non-sag coating of miscible liquids being formed on a vertical surface.

SUMMARY OF THE INVENTION

This invention is directed to a method for producing a substantially non-sag coating on a coating area of a substantially vertical substrate surface. The liquid mixture includes at least two miscible component liquids. The method comprises the steps of: (a) applying a coating of the liquid mixture to the coating area of a substrate surface from a first edge of the coating area to a second edge of the coating area, the liquid mixture being applied to produce a liquid mixture thickness which increases continuously from the first edge to the second edge; and (b) situating at a higher vertical position whichever of the first edge or the second edge at which a surface tension of the liquid mixture will be greater, as the liquid mixture evaporates, than a surface tension of the liquid mixture at the other edge.

DETAILED DESCRIPTION OF THE INVENTION

Figure 1:
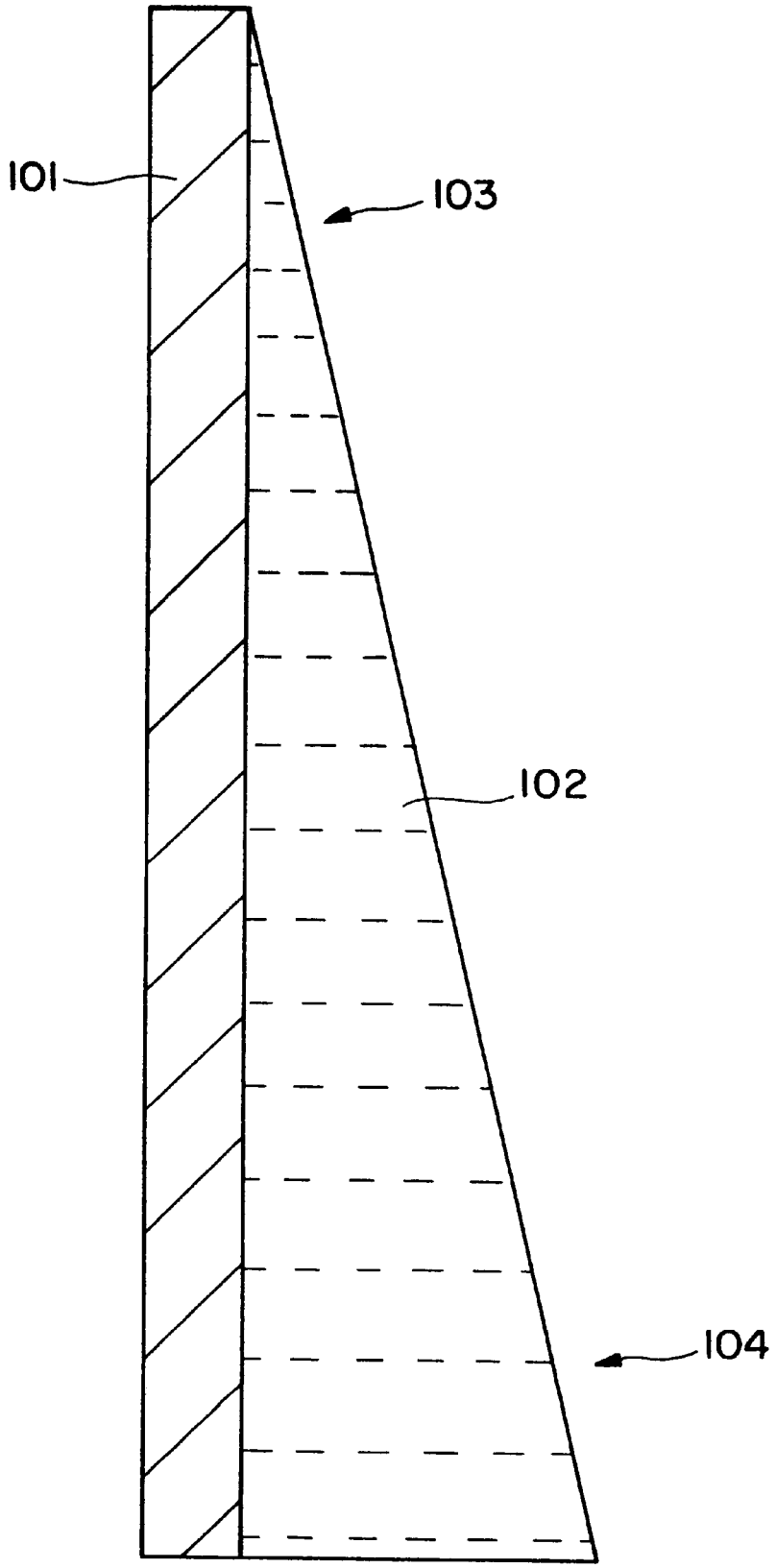
FIG. 1 is a side cross section of a substrate having a liquid mixture applied to it according to the method of this invention, wherein the liquid mixture has a surface tension that is raised as the liquid mixture evaporates.

This invention produces a substantially non-sag coating on a coating area of a substantially vertical substrate surface. The coating formed by the method of this invention has reduced tendencies to sag, run, or curtain. Without being bound to theory, this is believed to be accomplished by creating an approximate balance between the force due to surface tension and the force of gravity.

The term "substantially non-sag coating" refers to a coating that does not show, by unaided visual inspection, indications of sag, run, or curtain.

The liquid mixture is applied unevenly across a predetermined area to be coated so that the thickness of the applied liquid mixture increases continuously. After or during application of the liquid mixture, the edge of the predetermined area at which the film thickness is a maximum is situated either above or below the edge a which the film thickness is a minimum. The relative position of the edges is determined by the relative surface tensions of the component liquids of the liquid mixture. Typically, as the liquid mixture evaporates, the surface tension of the film either increases or decreases. This change in surface tension will vary with the film thickness. It is desired in the method of this invention to place in a higher vertical position, the edge at which the surface tension of the film will be greater as the liquid mixture evaporates.

The liquid mixture includes at least two miscible component liquids. The miscible component liquids can be combination of any convenient liquids such as for example, water/ethanol, water/methanol, water/isopropanol, water/glycol, water/propanol/methanol, ethanol/acetone,water/acetone, water/acetone/PM ("EPM" is short for propylene glycol monomethyl ether), or formamide/acetone.

Other additives such as, for example, surfactants, antioxidants, and colorants, can be conveniently included in the liquid mixture.

The miscible component liquids and the additives can be any convenient mixture suitable for a particular application. As described earlier, the method of the present invention for producing a substantially non-sag coating of miscible liquids on a vertical surface is applicable to many uses including, for example, window cleaners, oven cleaners, and any application that would benefit from a non-sag coating of miscible liquids being formed on a vertical surface.

The method applies a coating of the liquid mixture to the coating area of a substantially vertical substrate surface from a first edge of the coating area to a second edge of the coating area. The liquid mixture is applied to produce a liquid mixture thickness that increases continuously from the first edge to the second edge.

Either the first edge or the thicker second edge is at a higher vertical position than the other edge, depending on whichever of the first edge or the second edge at which a surface tension of the liquid mixture will be greater, as the liquid mixture evaporates, than a surface tension of the liquid mixture at the other edge.

Without being held to theory, it is believed that this invention innovatively takes advantage of localized changes in surface tension, as a liquid mixture coating evaporates, in order to produce a substantially non-sag coating. In general, the component liquids of a liquid mixture will have individual contributions to the surface tension of the liquid mixture and will have different volatilities.

Accordingly, as the liquid mixture evaporates, its composition generally will change thereby leading to a change in the surface tension. Although surface evaporation is substantially uniform, the localized composition at a thinner coating area will change differently from the localized composition at a thicker coating area because the evaporating mass represents a larger proportion of the local mass at the thinner coating area than at the thicker coating area.

Without being held to theory, it is believed that such localized differences in composition and surface tension urges the overall liquid mixture towards the coating area with the resulting higher surface tension —that is, towards the edge at which a surface tension of the liquid mixture will be greater, as the liquid mixture evaporates, than a surface tension of the liquid mixture at the other edge. It is believed that such urging causes the coatings, applied to a substantially vertical surface by the method of this invention, to form a substantially non-sag coating.

Referring to FIG. 1, a side cross section is shown of an embodiment of the invention in which a substrate 101 is applied with a liquid mixture 102 having a surface tension that is raised as the liquid mixture evaporates. As applied, liquid mixture 102 is purposely thinner at the upper edge than at the lower edge. Under conditions of uniform temperature and pressure, evaporation of liquid mixture 102 will be dependent only on surface area, and not on thickness. However, in regions of lower thickness 103, the proportional effect of surface evaporation on the lower-thickness region 103 of the liquid mixture 102 will be greater than on the greater thickness region 104, thus increasing the surface tension more in region 103 than in region 104. As the liquid mixture evaporates, the surface tension will thus be a maximum at the edge at which the thickness is a minimum. Hence, in the method of this invention, a surface is unevenly coated with a liquid mixture 102, having a surface tension that is raised as the liquid mixture evaporates, that is situated with the edge at which thickness is a minimum in a higher vertical position than the edge at which thickness is a maximum. As the liquid mixture evaporates, the higher surface tension at the thinner edge than at the thicker edge urges the mixture towards the upper thinner edge, which results in upward flow to produce a substantially non-sag film or coating.

Figure 2:
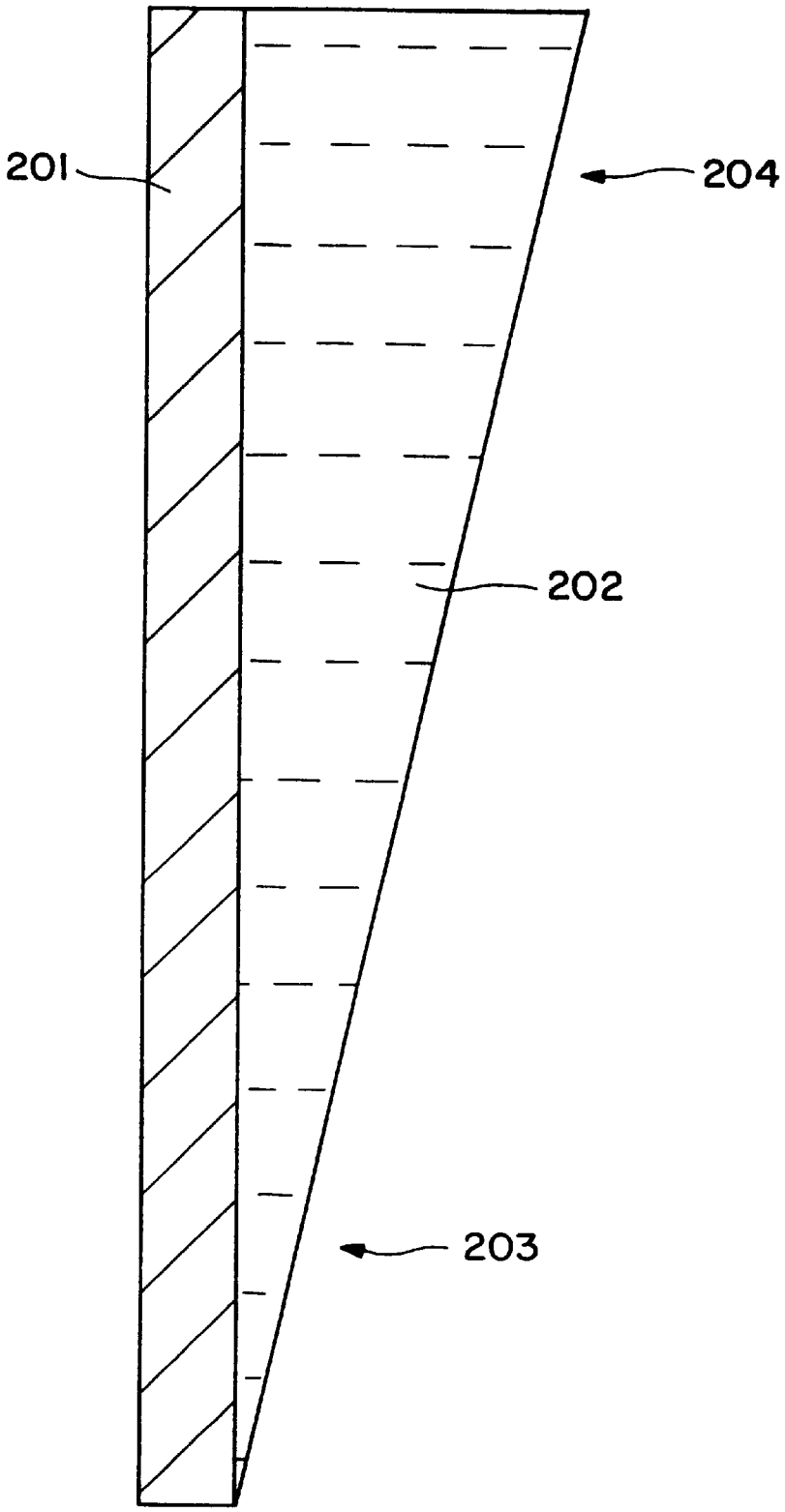
FIG. 2 is a side cross section of a substrate having a liquid mixture applied to it according to the method of this invention, wherein the liquid mixture has a surface tension that is lowered as the liquid mixture evaporates.

Referring to FIG. 2, a side cross section is shown of another embodiment of this invention in which a substrate 201 is applied with a liquid mixture 202 having a surface tension that is lowered as the liquid mixture evaporates. As applied, the liquid mixture 202 is purposely thicker at the upper edge than at the lower edge. Similarly to the above embodiment, under conditions of uniform temperature and pressure, evaporation of liquid mixture 202 will be dependent only on surface area, and not on thickness. However, in regions of lower thickness 203, the proportional effect of surface evaporation on the lower-thickness region 203 of the liquid mixture 202 will be greater than on the greater thickness region 204, thus increasing the surface tension more in region 204 than in region 203. As the liquid mixture 202 evaporates, the surface tension will thus be a maximum at the edge at which the thickness is a maximum. Hence, in the method of this invention, a surface is unevenly coated with a liquid mixture 102, having a surface tension that is lowered as the liquid mixture evaporates, that is situated with the edge at which thickness is a minimum in a lower vertical position than the edge at which thickness is a maximum. As the liquid mixture evaporates, the higher surface tension at the thicker edge than at the thinner edge urges the mixture towards the upper thicker edge, which results in upward flow that retards downward flow due to gravitational forces, to produce a substantially non-sag film.

The liquid mixtures may be applied by any convenient technique such as, for example, by being drawn, sprayed, electrostatically applied, bell and disc applied, and by being rolled. A suitable technique places the surface in a horizontal position, applying the liquid mixture to the surface, drawing the liquid mixture on the surface with a wire wound rod supported on one side with a shim to produce a thickness gradient, and then repositioning the surface vertically in the proper orientation, depending on the surface tension/evaporating properties of the liquid mixture. The thickness gradient is defined in terms of the increase in thickness with distance along the surface, and is measured in mils/inch (mm/cm) of surface. Suitable gradients of coating thickness across the surface will vary with the nature of the liquid mixture. The substrate may be left in a vertical orientation during application of an appropriate liquid mixture.

It is preferred that the gradient be about 0.5 mil/inch (0.005 mm/cm) to about 2.0 mil/inch (0.02 mm/cm), more preferably from about 0.6 mil/inch (0.006 mm/cm) to about 1.5 mil/inch (0.015 mm/cm), and most preferably from about 0.8 mil/inch (0.008 mm/cm) to about 1.2 mil/inch (0.012 mm/cm).

The Examples which follow are intended as an illustration of certain preferred embodiments of the invention, and no limitation of the invention is implied.

EXAMPLES

Example 1 and Comparative Examples 1–4

Water/Acetone.

A mixture of 90:10 by volume water:acetone was made. In Example 1, tape was applied to a side of a steel substrate to define an area approximately 3"×3.5" (approx. 7.5 cm×9 cm) with the tape along the longer dimension. The tape was measured to be approximately 4 mil (approx. 0.1 mm) thick. The water/acetone mixture was applied to the defined area by using a 1 mil (0.0254 mm) drawdown bar. The drawdown bar was swept across the defined area with one edge of the bar raised from the surface by the tape, thereby forming a layer of mixture that was 1 mil (0.0254 mm) deep at one edge and gradually rose to approximately 5 mil (approx. 0.13 mm) deep at the opposite edge by the tape. The substrate was immediately turned to the vertical with the tape edge at the bottom.

Comparative Example 1 was made the same way as Example 1 except that the substrate was immediately turned to the vertical with the tape edge at the top.

Comparative Examples 2–4 were made with the mixture applied to a plain substrate. Comparative Example 2 used a 2 mil (0.05 mm) drawdown bar, Comparative Example 3 used a 3 mil (0.07 mm) drawdown bar, and Comparative Example 4 used a 4 mil (0.1) drawdown bar.

Comparative Example 1 showed initial running of the solvent downwards, Comparative Example 2 showed no running, Comparative Example 3 showed dripping, and Comparative Example 4 also showed dripping.

Example 1 showed less running that Comparative Example 1 and the mixture was seen migrating upwards, counteracting gravity.

It is known that sufficiently thin layers will resist running. Accordingly, Comparative Example 2 was thin enough not to run. However, Example 2 applied the mixture at a considerably lower level of coverage than that of Example 1. Thus, Example 1 should be compared to Comparative Example 3 which had approximately the same average amount of mixture per unit area as Example 1, or to Comparative Example 4 which had the same depth of coverage as that of the deep part of Example 1. In comparison to those Comparative Examples, the present invention showed increased resistance to running and dripping. In particular, it was seen that the graduated depth of the present invention caused the mixture to migrate against gravity to counteract the effects of gravity on the mixture.

Water has a higher surface tension (approximately 72 dynes/cm or 72 mN/m) than acetone (approximately 23 dynes/cm or 23 mN/m). As the more volatile acetone evaporates, the mixture surface tension is increased. Further, the shallower part of the applied water/acetone mixture will lose proportionally more acetone than that lost by the deeper part of the mixture. Accordingly, in this case, the shallower part of the applied mixture should be at the top while the deeper part of the mixture should be at the bottom so that the effect of the increased surface tension is to pull up the mixture, as was seen in Example 1, above.

Example 2 and Comparative Example 5

Water/Acetone/Red Food Dye.

A graduated depth coating was formed similarly as Example 1 above except that a small amount of red food dye was added to the 90:10 by volume water/acetone mixture. The food dye clearly made visible the migration of the mixture upwards.

Comparative Example 5 was made similarly as Comparative Example 3. In this case, no migration was shown by the food dye and dripping was seen.

Comparative Examples 6–8

Pure Water.

Coatings were made: Comparative Example 6 similarly to Example 1; Comparative Example 7 similarly to Comparative Example 1; and Comparative Example 8 similarly to Comparative Example 3; except that pure water was used instead of a water/acetone mixture. In all these cases, running and dripping were observed with no migration of the coating upwards.

Comparative Examples 9–11

Pure Acetone.

Coatings were made: Comparative Example 9 similarly to Example 1; Comparative Example 10 similarly to Comparative Example 1; and Comparative Example 11 similarly to Comparative Example 3; except that pure acetone was used instead of a water/acetone mixture. In all these cases, running and dripping were observed with no migration of the coating upwards.

Example 3 and Comparative Examples 12 and 13

Formamide/Acetone/Food Coloring.

Coatings were made: Example 3 similarly to Example 1; Comparative Example 12 similarly to Comparative Example 1; and Comparative Example 13 similarly to Comparative Example 3; except that a formamide/acetone (80:20 by volume) mixture was used with a small amount of red food coloring added for visibility.

Comparative Example 12 showed running and dripping. Comparative Example 13 showed no migration, with running and dripping. Example 3 showed migration upwards and resistance to running (only slight running), with no dripping.

Formamide has a higher surface tension (approximately 58 dynes/cm or 58 mN/m) than acetone (approximately 23 dynes/cm or 23 mN/m). As the more volatile acetone evaporates, the mixture surface tension is increased. Further, the shallower part of the applied formamide/acetone mixture will lose proportionally more acetone than that lost by the deeper part of the mixture. Accordingly, in this case, the shallower part of the applied mixture should be at the top while the deeper part of the mixture should be at the bottom so that the effect of the increased surface tension is to pull up the mixture.

Other variations and modifications of this invention will be apparent to those skilled in this art after careful study of this application. This invention is not to be limited except as set forth in the following claims.

What is claimed is:

1. A method for producing a non-sagging liquid mixture coating on a substantially vertical substrate surface comprising applying to said substrate a coating of a liquid mixture comprising water and a least one miscible liquid having a lower surface tension than water and selected from the group consisting of methanol, ethanol, propanol, isopropanol, acetone, propylene glycol monoethylether and formamide wherein said coating is applied to a coating area of said surface in a coating having a thickness which increases continuously from an upper edge to a lower edge of said coating area, wherein as said liquid mixture evaporates surface tension forces inhibit the tendency of said mixture to sag.

2. A method according to claim 1 wherein said liquid mixture is applied by being sprayed onto said sucface of coating area to provide a coating having a thickness which increases continuously from an upper edge to a lower edge of said coating area.

* * * * *